US005347751A

United States Patent [19]

Carpay

[11] Patent Number: 5,347,751

[45] Date of Patent: Sep. 20, 1994

[54] MODULAR PLANT STAND

[76] Inventor: Frans Carpay, #308 - 889 W. 7th Avenue, Vancouver, British Columbia, Canada, V5Z 1C2

[21] Appl. No.: 132,576

[22] Filed: Oct. 6, 1993

[51] Int. Cl.[5] ..... A47G 7/00

[52] U.S. Cl. ..... 47/39; 47/72

[58] Field of Search ..... 47/39, 72, 60 R, 60 NL, 47/60 EC

[56] References Cited

U.S. PATENT DOCUMENTS

| | | | |
|---|---|---|---|
| 1,293,316 | 2/1919 | Bogert | 47/72 |
| 2,792,142 | 5/1957 | Sandkuhle . | |
| 4,031,663 | 6/1977 | Brunk . | |
| 4,062,147 | 12/1977 | Phillips . | |
| 4,349,864 | 9/1982 | Smith | 47/39 |
| 4,996,792 | 3/1991 | Holtkamp, Sr. | 47/39 |
| 5,095,650 | 3/1992 | DeMarco | 47/60 R |

FOREIGN PATENT DOCUMENTS

| | | | |
|---|---|---|---|
| 513373 | 8/1952 | Belgium | 47/63 |
| 0074635 | 3/1983 | European Pat. Off. | 47/39 |
| 66888 | 4/1965 | France . | |
| 1377416 | 4/1966 | France | 47/72 |
| 2562407 | 10/1985 | France | 47/39 |
| 10233 | of 1900 | United Kingdom | 47/72 |

*Primary Examiner*—Ramon S. Britts
*Assistant Examiner*—Joanne C. Downs
*Attorney, Agent, or Firm*—Oyen Wiggs Green & Mutala

[57] ABSTRACT

A modular plant stand is disclosed. The plant stand may be assembled easily from a kit. When disassembled, the parts of the plant stand may stacked together in a compact bundle for shipping or storage. The plant stand has a number of vertical corner members, a number of wall panels which fit between adjacent corner members, a top collar and a bottom collar. The corner members and wall panels fit into channels in the top and bottom collars. The top collar has an inwardly extending flange from which an inner soil-containing liner, which may be a plant pot may be suspended from its top edge. The inner liner hangs down inside the plant stand and is therefore hidden from view. The sides and bottom of the inner liner are exposed to the air inside the plant stand and are therefore well ventilated. The weight of the inner liner and any materials that it contains helps to stabilize and hold together the plant stand. The bottom collar of the plant stand may be equipped with a flange to support a drip tray below the inner liner.

22 Claims, 6 Drawing Sheets

MODULAR PLANT STAND

FIELD OF THE INVENTION

This invention relates to a modular stand for holding potted plants above the ground for display.

BACKGROUND OF THE INVENTION

Plants which are supplied by a nursery often come in unattractive pots which are not suitable for display in formal surroundings, such as a home or office. Almost all such plant pots are in one of several standard sizes. Furthermore, smaller plants must be supported off the ground to be best appreciated.

Sandkuhle, U.S. Pat. No. 2,792,142 discloses a knock-down wooden container for plants. The Sandkuhle container has the disadvantage that it is held together by straps which are wrapped around outside the container. These straps are both somewhat awkward to fasten and unattractive in appearance. Furthermore, the Sandkuhle container is tapered in width and thickness. If the Sandkuhle container were made tall it would also be quite broad because its sides slope outwardly. When the Sandkuhle container is in use, the soil inside the container is in direct contact with the wall of the container. Sandkuhle does not provide an inner liner or a means for collecting water draining from the container.

French patent No. 66.888 dated Apr. 12, 1865 discloses a planting pot having a number of vertical wall panels held in place behind a number of corner pieces. The bottom edges of the corner pieces fit into a base. The top edges of the corner pieces are held together by a strap which passes around the plant pot through hooks on the outsides of the corner pieces. The wall panels are apparently held in place by the weight of soil inside the pot which presses directly against the inside faces of the wall panels. Once again, the strap, and the hooks which hold the strap in place are not particularly attractive and there is no provision for an inner liner.

SUMMARY OF THE INVENTION

A first aspect of the invention provides a plant stand comprising a first collar, a second collar spaced apart from and parallel to said first collar, and at least one wall panel member. The first collar comprises a ring of material surrounding a central aperture, a first surface, and a first channel in the first surface, the first channel extending around the central aperture. The second collar comprises a second surface facing the first surface and a second channel in the second surface. The second channel is a mirror image of said first channel. The wall panel member has a first end engaged in the first channel and a second end engaged in the second channel. The first aspect of the invention also provides liner suspension means associated with the first collar for suspending a liner within the central aperture.

A second aspect of the invention provides a plant stand comprising three or more corner members, three or more wall panels, a top collar and a bottom collar. Each corner member comprises top and bottom ends and wall panel engagement means for receiving a side edge of a wall panel. The wall panels extend between wall panel engagement means on pairs of adjacent corner members. The wall panels each have top, bottom and side edges. The top collar comprises a top channel for receiving the top ends of the corner members and the top edges of the wall panels, a central aperture, and inner liner retaining means for supporting an inner liner in the central aperture. The bottom collar comprises a bottom channel for receiving the bottom ends of the corner members and the bottom edges of the wall panels.

In a preferred embodiment the corner members comprise an outer portion, a planar inner portion, and a web of material connecting the inner and outer portions. The inner and outer portions define between themselves longitudinal grooves on either side of the web.

The invention further provides a modular plant stand comprising six vertical corner members arranged at the corners of a regular hexagon, six wall panels, a top collar, a bottom collar, a plant-pot, and a drip-tray. Each corner member has five sides and comprises a pair of longitudinally extending grooves disposed with their longitudinal mid-planes intersecting each other at an angle of 60°, a top end and a bottom end. The six wall panels each have top, bottom and side edges. The side edges of each wall panel engaged are engaged in the grooves in an adjacent pair of corner members. The top collar comprises a downward-facing hexagonal channel having a mouth for receiving the top ends of the corner members and the top edges of the wall panels and a horizontal flange extending inwardly from an inside edge of the mouth of the channel. The bottom collar comprises an upward-facing hexagonal channel having a mouth for receiving the bottom ends of the corner members and the bottom edges of the wall panels and a horizontal flange extending inwardly from an inside edge of the mouth of the channel. The plant-pot is suspended from the flange of the top collar. The drip-tray is supported on the flange of the bottom collar.

BRIEF DESCRIPTION OF THE DRAWINGS

In drawings which illustrate specific embodiments of the invention, but which should not be construed as restricting the spirit or scope of the invention in any way.

DETAILED DESCRIPTION OF THE PREFERRED EMBODIMENT

Figure 1:
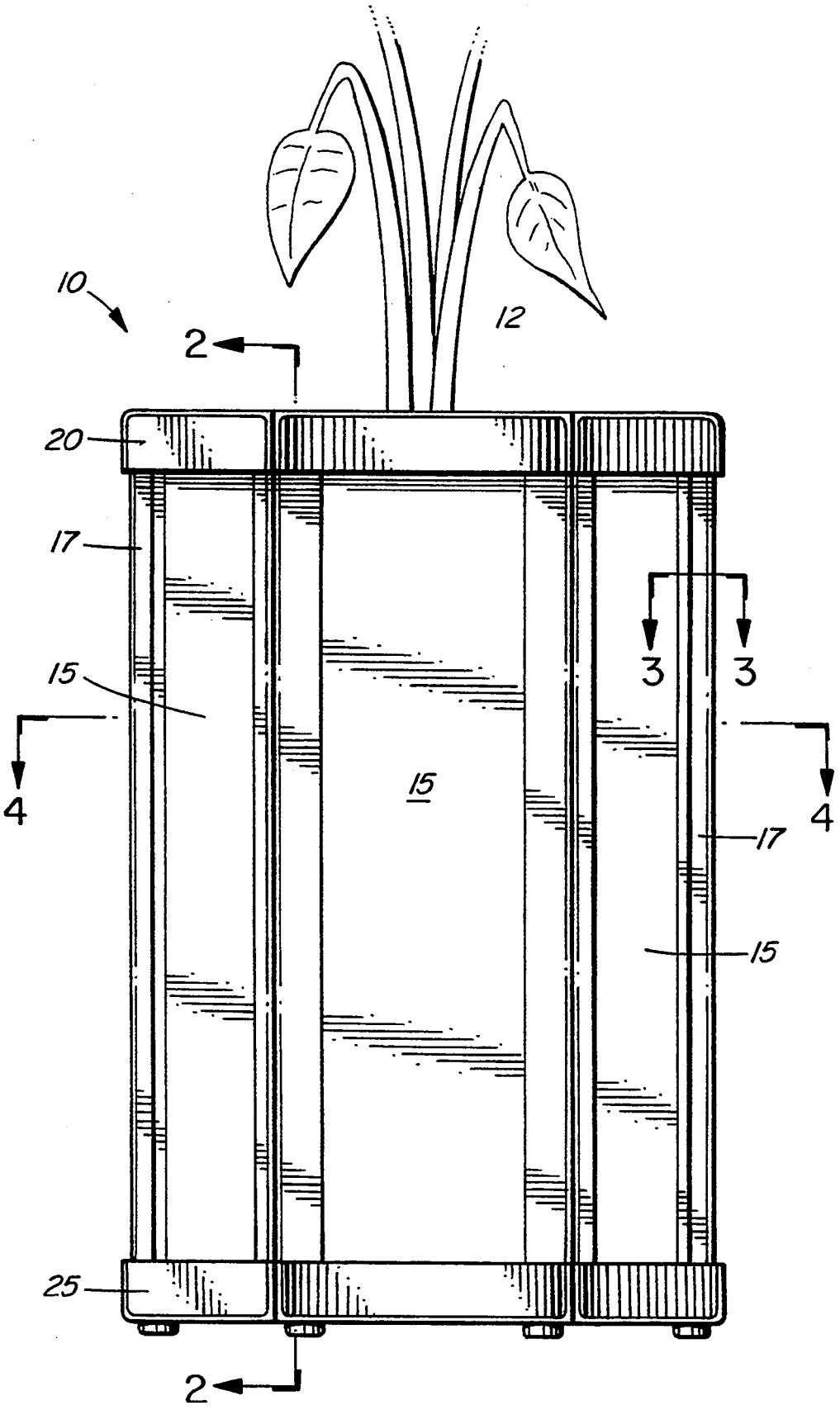
FIG. 1 is a side elevation of a plant stand according to the invention.
Figure 2:
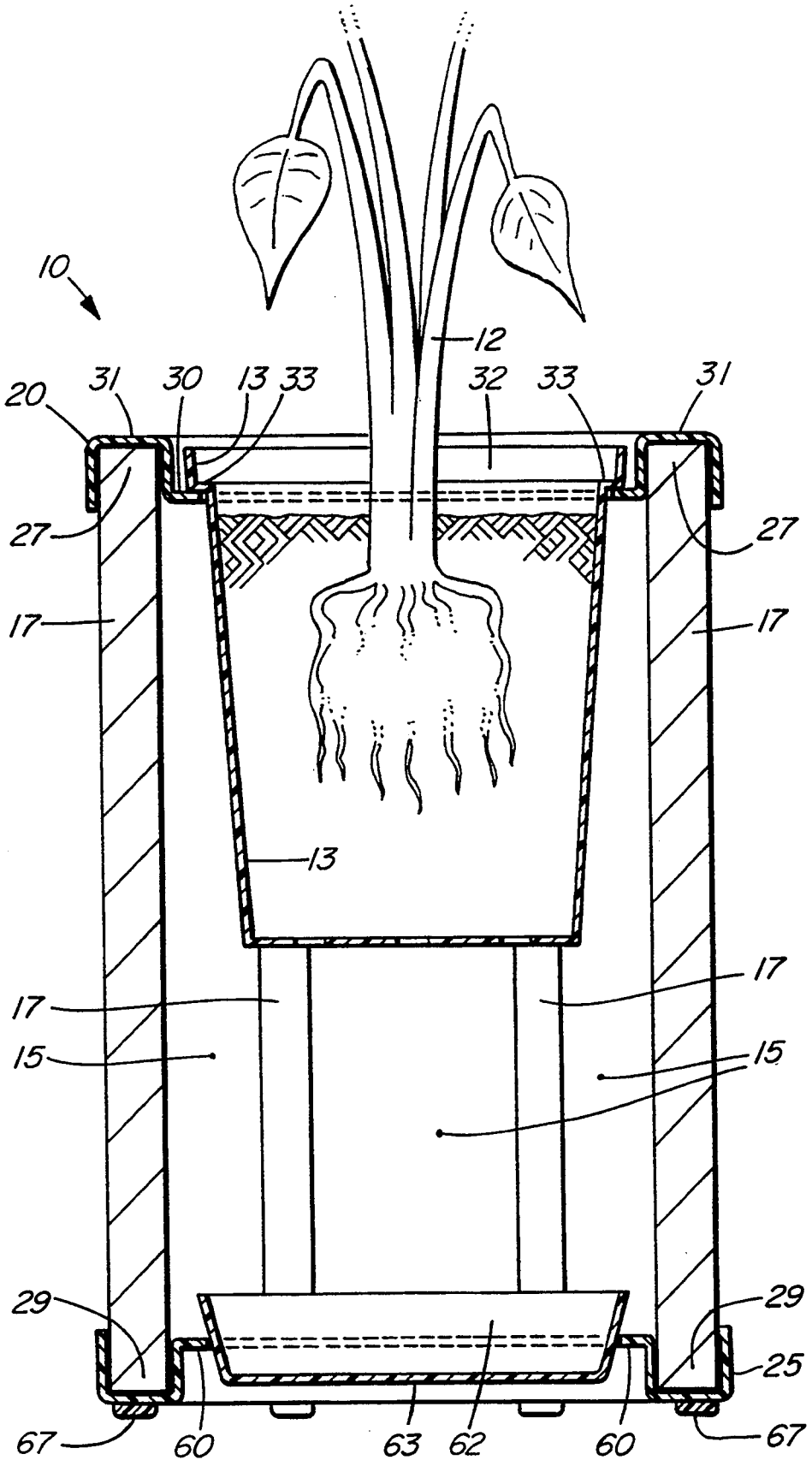
FIG. 2 is a vertical section through the plant stand of FIG. 1.

FIGS. 1 and 2 show a plant stand 10 for supporting a plant 12 in an inner liner 13. Inner liner 13 may be a standard sized plant pot. Plant stand 10 is comprised of wall panels 15 which are held in place between corner members 17, top collar 20, and bottom collar 25. FIG. 2 is a vertical section through the plant stand 10 shown in FIG. 1.

Top flange 20 has a channel 27 which receives the top ends of corner members 17 and the top edges of wall panels 15. Bottom collar 25 has a similar channel 29 for receiving the bottom ends of corner members 17 and the bottom edges of wall panels 15. Wall panels 15 and corner members 17 are thus engaged between top collar 20 and bottom collar 25.

Corner members 17 are preferably extruded aluminum although they may be made out of any attractive material such as wood or plastic. Where corner members 17 are made from an extruded material, corner members 17 preferably have the cross sectional shape shown in FIGS. 3 and 4. This minimizes the amount of material used to make corner members 17.

Figure 3:
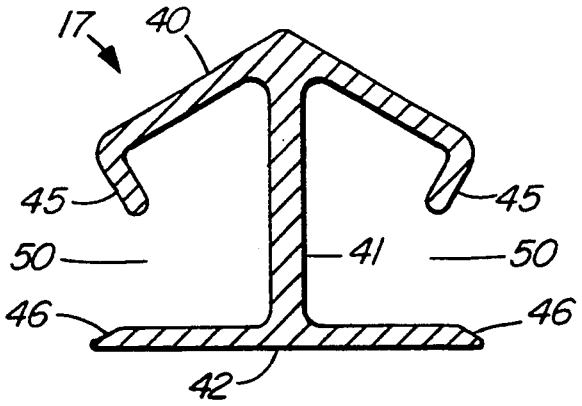
FIG. 3 is a horizontal section through a corner member for the plant stand of FIG. 1.
Figure 4:
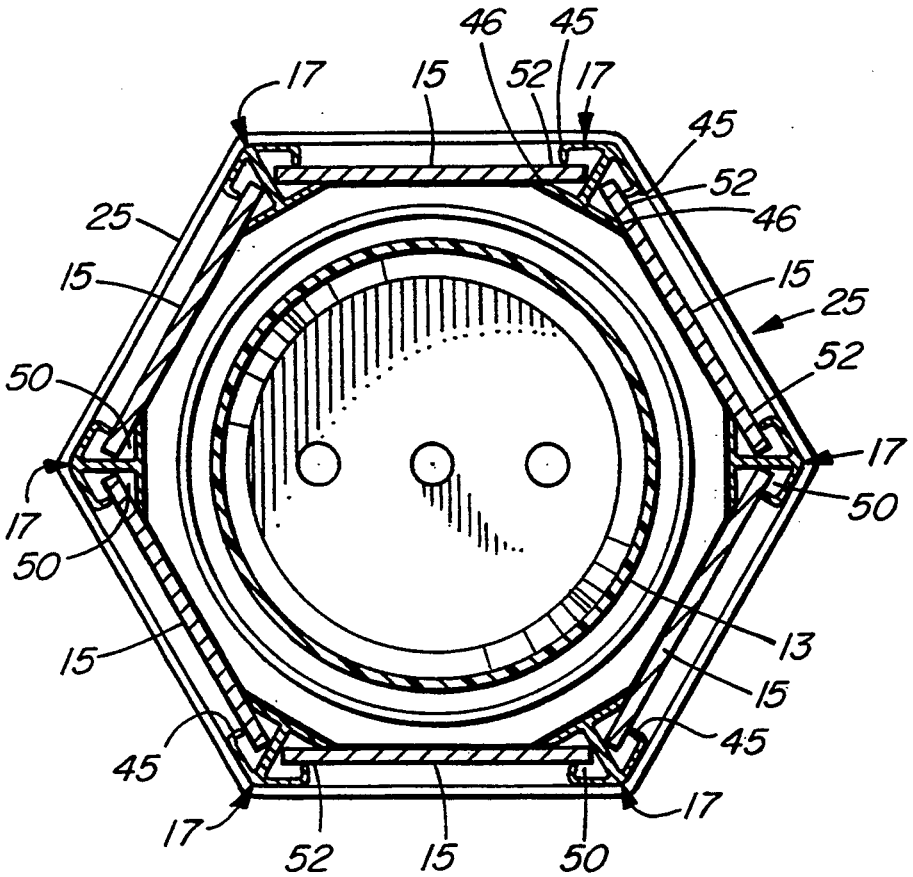
FIG. 4 is a horizontal section through the plant stand of FIG. 1.

As shown in FIG. 3, corner members 17 preferably comprise a bent outer portion 40, an inner base 42, and a web 41 of material joining outer portion 40 to inner base 42. Outer portion 40 and inner base 42 together form a pair of broad longitudinal grooves 50 in corner members 17. Outer portion 40 has a pair of inwardly extending ridges 45. Inner base 42 has bevelled edges 46. As shown in FIG. 4, the edges 52 of wall panels 15 are received in grooves 50 between ridges 45 and bevelled edges 46. The sides of wall panels 15 are thus held in place in plant stand 10. Ridges 45 constitute wall-panel contacting ridges extending inwardly from outer walls 40 of grooves 50.

Figure 5:
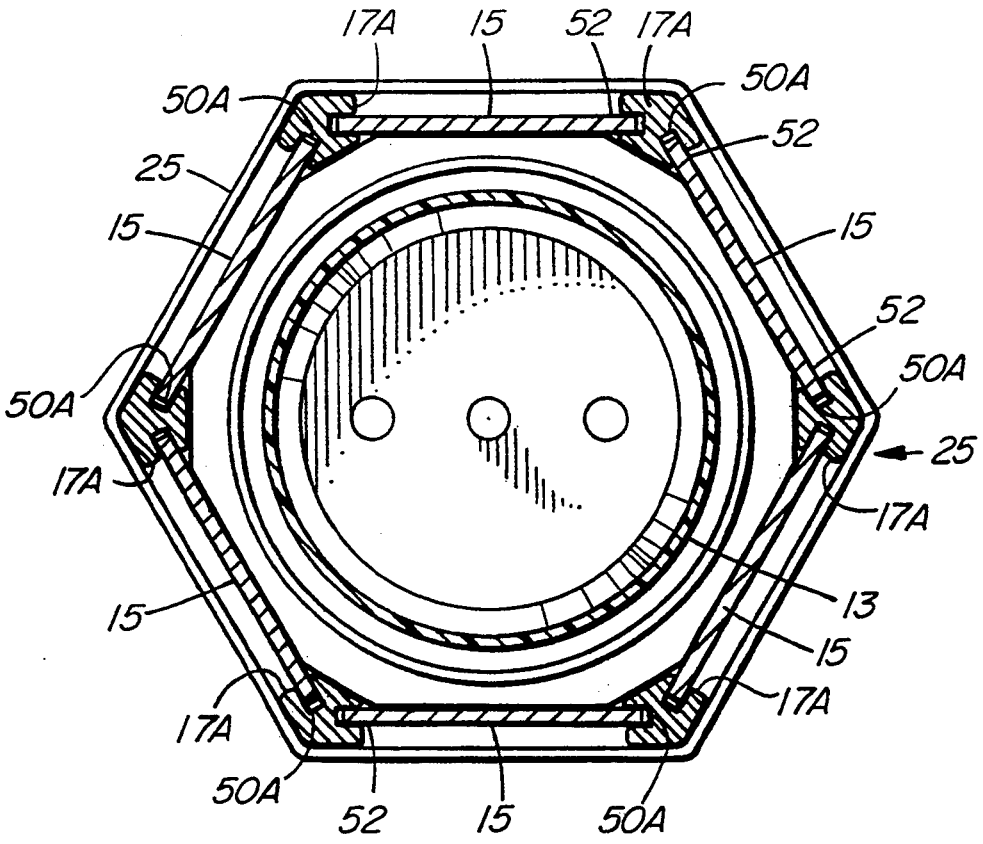
FIG. 5 is a horizontal section through a plant stand constructed with an alternative configuration of corner members.
Figure 6:
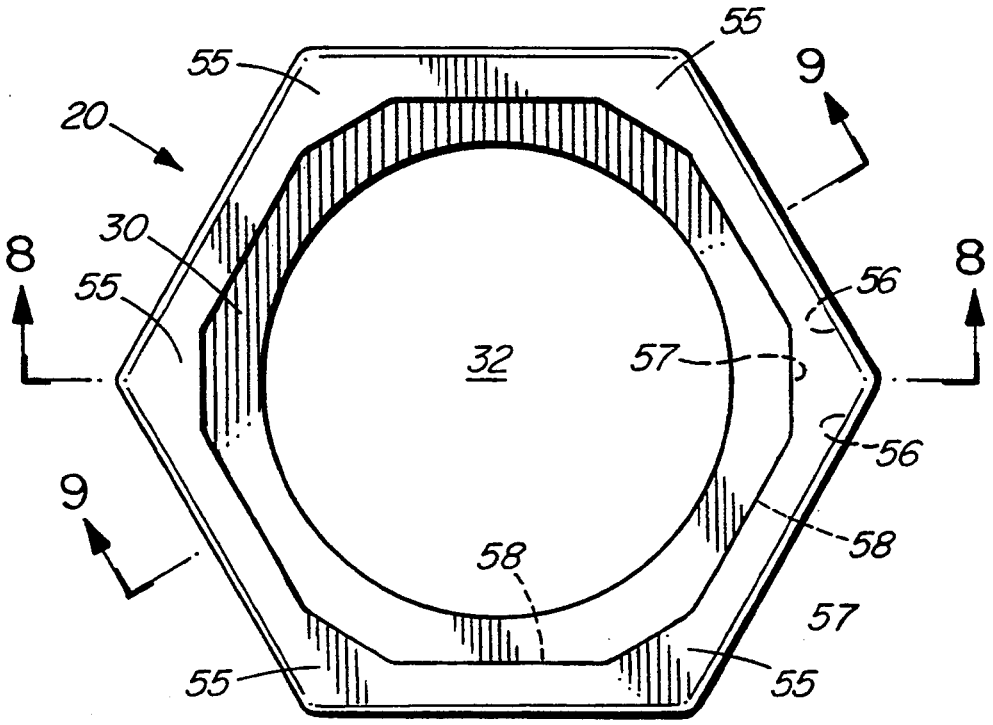
FIG. 6 is a top plan view of the top collar of the plant stand shown in FIG. 1.
Figure 7:
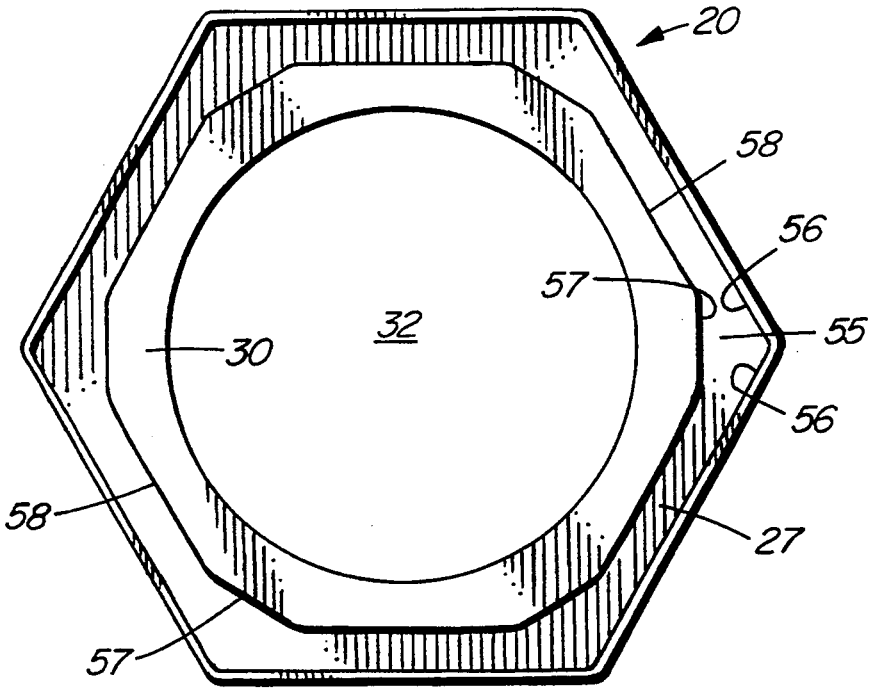
FIG. 7 is a bottom plan view of the top collar of the plant stand shown in FIG. 1.

In an alternative embodiment of the invention, as shown in FIG. 5, corner members 17A are solid and have a pair of longitudinal grooves 50A extending along their lengths. Grooves 50A are as wide as the side edges 52 of wall panels 15 are thick. The edges 52 of wall panels 15 fit into grooves 50A to retain wall panels 15 in plant stand 10.

Wall panels 15 may be wood, plastic, ceramic tile, or some other attractive material. The appearance of plant stand 10 may be coordinated to match the surrounding decor by changing wall panels 15. This can be accomplished while retaining standard corner members 17 and collars 20, 25. Because plant stand 10 is easy to assemble, even a very unsophisticated user can easily make a plant stand 10 from a kit without outside help.

As shown in FIGS. 6 to 9, channel 27 in top collar 20 preferably comprises a number of corner segments 55 at its corners for receiving the top ends of corner members 17. The segments of channel 27 between corner segments 55 are narrow relative to corner segments 55. The inner walls 58 of the narrow portions of channel 27 between corner segments 55 are preferably straight. Channel 29 in bottom collar 25 is preferably a mirror image of channel 27 in top collar 20.

Figure 10:
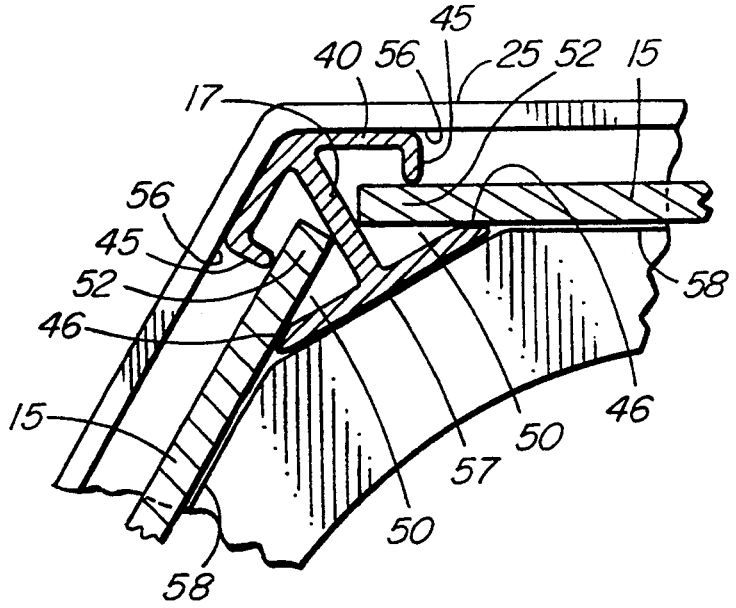
FIG. 10 is a fragmentary sectional view of the plant stand shown in FIG. 1 showing the underside of the top collar.

Corner segments 55 are preferably triangular. As shown in FIG. 10, corner members 17 are preferably shaped to fit snugly into triangular corner segments 55. The two faces of outer portion 40 of each corner member 17 fit against the two outer sides 56 of corner segment 55. The face of base portion 42 of corner member 17 fits against the inner side 57 of corner segment 55.

As shown in FIG. 5, where alternative corner members 17A are used, the two faces of corner member 17A, which bear longitudinal grooves 50 face the narrow portions of channel 27.

FIG. 10, is a partial sectional view through the plant stand of FIG. 1 looking upward toward top collar 20. As shown in FIG. 10, wall panels 15 are received in corner members 17 between ridges 45 and bevelled edges 46. Bevelled edges 46 form continuations of inner walls 58. Ridges 45 hold wall panels 15 against bevelled edges 46 and inner walls 58. Plant stand 10 may be strengthened and permanently assembled by o applying a suitable adhesive between inner walls 58 and wall panels 15.

Top collar 20 and bottom collar 25 are preferably made of a mouldable weather-resistant plastic such as ROYALITE TM R84 thermoplastic sheet which is available from Royalite Thermoplastics Division of Polycast Technology Corporation of Mishawaka, Indiana. The material of top collar 20 and bottom collar 25 is typically approximately 0.1 inches in thickness. Top collar 20 and bottom collar 25 may also be advantageously fabricated from standard ABS plastic laminated together with a thin layer of plastic which is resistant to weathering. For example, a layer of ABS plastic 0.09 inches thick may be laminated together with a layer of ROYALITE TM R84 thermoplastic sheet approximately 0.01 inches thick. The thin ultraviolet resistant layer of ROYALITE TM plastic prevents weathering of the underlying ABS plastic. Top collar 20 and bottom collar 25 may be fabricated using standard vacuum forming techniques.

As shown in FIG. 2, top collar 20 has a flange 30 extending inwardly from the inside edge of the mouth of channel 27. Flange 30 surrounds an aperture 32 which is dimensioned to accept inner liner 13. Inner liner 13 sits in aperture 32 and the combined weight of plant 12, inner liner 13 and the other contents of inner liner 13 is borne by flange 30. The outer surface of inner liner 13 preferably has an outwardly projecting step 33 which sits on top of flange 30. Flange 30 is preferably located below the rim 31 of top collar 20 so that the portions of inner liner 13 which project above flange 30 are somewhat hidden from view. This construction of flange 30 also helps to lock top collar 20 in place in plant stand 10.

As shown in FIG. 2, bottom collar 25 preferably has a flange 60 extending inwardly from the inward edge of the mouth of channel 29 Flange 60 surrounds an aperture 62. Flange 60 provides means for supporting a drip tray 63 below inner liner 13. Bottom flange 25 may also have feet 67 for holding plant stand 10 slightly clear of the ground.

Figure 11:
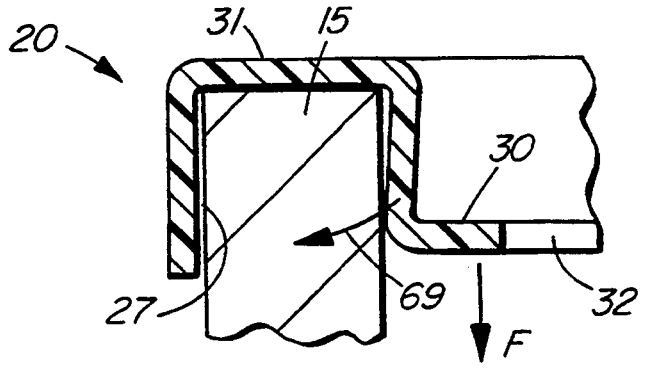
FIG. 11 is a diagram illustrating the clamping action of the top collar shown in FIG. 4.

The weight of inner liner 13 and its contents on flange 30 helps to hold top collar 20 tightly in place on plant stand 10. Furthermore, as shown in FIG. 11, if top collar 20 is formed of material which is somewhat flexible then the weight of inner liner 13 on flange 30 tends to slightly deform the mouth of channel 27 so that the top edges of wall panels 15 and the top ends of corner members 17 are retained tightly within channel 27. When a weight, indicated by F, is applied to the lip of flange 30 then flange 30 bends slightly downward. This causes the inner wall of channel 27 to deform slightly by moving outward as indicated by arrow 69 thus gripping wall panel 15 within channel 27 and enhancing the rigidity of plant stand 10.

Figure 8:
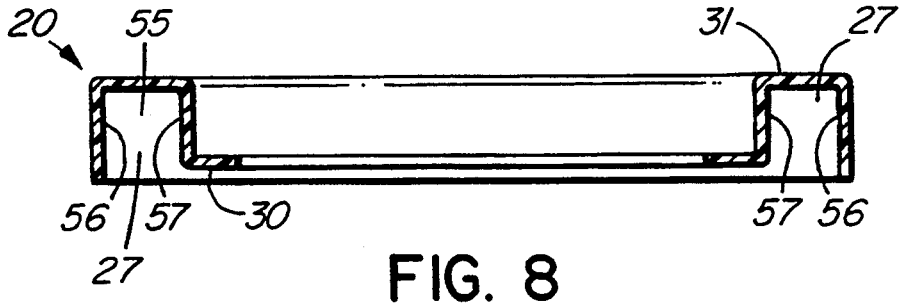
FIG. 8 is a section along line 8—8 of the collar shown in FIG. 6.
Figure 9:
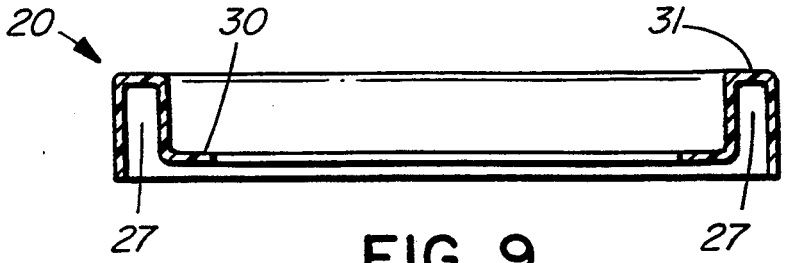
FIG. 9 is a section along line 9—9 of the collar shown in FIG. 6.

All of the parts of plant stand 10 may then be stacked into a compact flat package for storage or shipping. It is also possible to store or ship a smaller plant stand after it has been assembled by nesting it inside aperture 32 of a larger diameter plant stand 10 of equal height. If this is to be done then, preferably, the outer side faces of top collar 20 on the smaller plant stand descend slightly below the level of flange 30 as shown in FIGS. 8 and 9. The inner edge of flange 30 on the larger plant stand will then not be able to rub against corner members 17 of the smaller plant stand during shipping. Instead the inner edges of flange 30 on the larger plant stand will rub against the outer side faces of top collar 20 on the smaller plant stand which are likely to be more resistant to wear than corner members 17. Bottom collar 25 is preferably constructed similarly.

Figure 12:
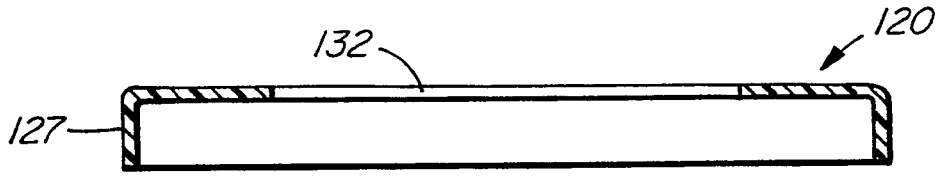
FIG. 12 is a section through an alternative non-preferred top flange according to the invention.

In an alternative non-preferred embodiment of the invention shown in FIG. 12, top flange 120 has a central aperture 132 for suspending a inner liner and a skirt 127. Skirt 127 holds corner members 17 and wall panels 15 in place by bearing on their outside edges. The embodiment shown in FIG. 12 is not preferred because it does not support wall panels 15 from inside plant stand 10 and it does not hide the upper edge of inner liner 13 from view.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A plant stand comprising:

a. a first collar, said first collar comprising a ring of material surrounding a central aperture, a first surface, and a first channel in said first surface, said first channel extending around said central aperture;

b. a second collar spaced apart from and parallel to said first collar, said second collar comprising a second surface facing said first surface and a second channel in said second surface, said second channel being a mirror image of said first channel;

c. at least one wall panel member having a first end engaged in said first channel and a second end engaged in said second channel; and d. liner suspension means associated with said first collar for suspending a liner within said central aperture.

2. The plant stand of claim 1 wherein said liner suspension means comprises a flange extending into said central aperture.

3. A plant stand comprising:

a. at least three corner members, each corner member comprising top and bottom ends and wall panel engagement means for receiving a side edge of a wall panel;

b. at least three wall panels extending between said wall panel engagement means on pairs of adjacent corner members, said wall panels each having top, bottom and side edges;

c. a top collar comprising a first channel for receiving said top ends of said corner members and said top edges of said wall panels, a central aperture, and inner liner retaining means for supporting an inner liner in said central aperture; and d. a bottom collar comprising a second channel for receiving said bottom ends of said corner members and said bottom edges of said wall panels.

4. The plant stand of claim 3 wherein said wall panel engagement means comprise longitudinal grooves in said corner members.

5. The plant stand of claim 4 wherein said grooves further comprise first and second walls and a wall panel contacting ridge extending into said groove from said first wall of said groove.

6. The plant stand of claim 3 wherein said corner member comprises an outer portion, a planar inner portion, and a web of material connecting said inner and outer portions wherein said inner and outer portions define between themselves longitudinal grooves on either side of said web.

7. The plant stand of claim 6 wherein said planar inner portion has edges bevelled at an angle inwardly toward said grooves.

8. The plant stand of claim 7 wherein said top channel comprises a number of generally triangular corner segments arranged at the corners of a polygon and an equal number of straight segments linking said corner segments, said planar inner portion has a width equal to a width of an inward side of one of said corner segments, and said angle of bevel of said inner portion edges is equal to an angle between said inward side of said one of said corner segments and one of said straight segments adjacent said corner segment.

9. The plant stand of claim 3 wherein said corner members are vertical, said wall panels are rectangular, and said corner members are disposed at the corners of a regular polygon.

10. The plant stand of claim 9 wherein said top channel comprises a number of generally triangular corner segments arranged at the corners of said polygon and an equal number of straight segments linking said corner segments.

11. The plant stand of claim 9 wherein said inner liner retaining means comprises a flange and said top collar comprises a flexible material wherein an inward side of said channel is displaced outwardly when a downward force is applied to said flange.

12. The plant stand of claim 11 wherein said corner members are five-sided.

13. The plant stand of claim 12 wherein said wall panel engagement means comprise grooves extending longitudinally along said corner members.

14. The plant stand of claim 3 wherein said inner liner retaining means is an inwardly extending flange.

15. The plant stand of claim 14 wherein said flange is below said top edges of said wall panels.

16. The plant stand of claim 15 wherein said flange extends inwardly from an inside edge of said first channel.

17. The plant stand of claim 16 wherein said wall panel engagement means are grooves extending longitudinally along said corner member and said side edges of said wall panels are engaged in said grooves.

18. The plant stand of claim 17 comprising six corner members arranged at the corners of a regular hexagon.

19. The plant stand of claim 17 comprising eight corner members arranged at the corners of a regular octagon.

20. The plant stand of claim 14 wherein said wall panels are ceramic tiles.

21. The plant stand of claim 14 wherein said bottom collar further comprises a central aperture and a flange extending inwardly into said central aperture for receiving a drip-tray.

22. A modular plant stand comprising:

a. six vertical corner members arranged at the corners of a regular hexagon, each corner member having five sides and comprising a pair of longitudinally extending grooves disposed with their longitudinal mid-planes intersecting each other at an angle of 60°, a top end and a bottom end;

b. six wall panels, each having top, bottom and side edges said side edges of each wall panel engaged in said grooves in an adjacent pair of said corner members;

c. a top collar comprising a downward-facing hexagonal channel having a mouth for receiving said top ends of said corner members and said top edges of said wall panels and a horizontal flange extending inwardly from an inside edge of said mouth of said channel;

d. a bottom collar comprising an upward-facing hexagonal channel having a mouth for receiving said bottom ends of said corner members and said bottom edges of said wall panels and a horizontal flange extending inwardly from an inside edge of said mouth of said channel;

e. a plant-pot suspended from said flange of said top collar; and f. a drip-tray supported on said flange of said bottom collar.

* * * * *